US006432001B1

(12) United States Patent
Pierce

(10) Patent No.: US 6,432,001 B1
(45) Date of Patent: Aug. 13, 2002

(54) FOOT POSITION TRAINER APPARATUS

(76) Inventor: Randall K. Pierce, 822 E. 2060 Rd., Eudora, KS (US) 66025

( * ) Notice: Subject to any disclaimer, the term of this patent is extended or adjusted under 35 U.S.C. 154(b) by 0 days.

(21) Appl. No.: 09/757,260

(22) Filed: Jan. 9, 2001

(51) Int. Cl.[7] ..... A63B 69/00

(52) U.S. Cl. ..... 473/452; 473/217; 473/458; 482/79; 36/127; 36/128

(58) Field of Search ..... 36/72 R, 77 R, 36/67 A, 80, 126–129, 136, 140–143; 482/79, 130, 145; 473/217, 452, 207, 451, 422, 415, 150

(56) References Cited

U.S. PATENT DOCUMENTS

| | | | | | |
|---|---|---|---|---|---|
| 1,831,851 | A | * | 11/1931 | Everett | 36/127 |
| 2,427,251 | A | * | 9/1947 | Bray | 36/128 |
| 2,760,774 | A | * | 8/1956 | Perez | 482/79 |
| 3,372,930 | A | * | 3/1968 | Sertich | 473/452 |
| 3,606,341 | A | * | 9/1971 | Honbarger | 473/217 |
| 3,815,906 | A | | 6/1974 | Hermo | |
| 4,194,735 | A | | 3/1980 | Wilson | |
| 4,516,772 | A | | 5/1985 | Stratton | |
| 4,932,656 | A | | 6/1990 | Pierce | |
| 4,998,720 | A | * | 3/1991 | Kim | 482/79 |
| 5,062,643 | A | * | 11/1991 | Bibbey et al. | 473/217 |
| 5,076,580 | A | | 12/1991 | Lang | |
| 5,642,880 | A | | 7/1997 | Wiseman et al. | |
| D399,280 | S | | 10/1998 | Griffin | |
| 5,947,833 | A | | 9/1999 | Alward | |
| 6,167,641 | B1 | * | 1/2001 | McMullin | 36/127 |
| 6,286,232 | B1 | * | 9/2001 | Snyder et al. | 36/43 |

* cited by examiner

*Primary Examiner*—Paul T. Sewell
*Assistant Examiner*—Mitra Aryanpour
(74) *Attorney, Agent, or Firm*—Dale J. Ream

(57) ABSTRACT

A foot position training apparatus for teaching proper foot position for batting a baseball includes a foot support member formed in the shape of the sole of a shoe. A toe portion is attached to a front edge of the support member and extends upwardly and rearwardly therefrom and defines a space for receiving the toes of a batter's foot and, more particularly, for receiving the toe portion of a batter's shoe. The toe portion restricts vertical movement of a batter's foot when batting a baseball. The apparatus further includes an upstanding wall extending along an outer edge of the support surface between the toe portion and a rear edge for restricting outward lateral movement of a batter's foot when batting a baseball. A plurality of cleats are threadably coupled to a lower surface of the foot support member for selectively engaging a ground surface.

2 Claims, 6 Drawing Sheets

FOOT POSITION TRAINER APPARATUS

BACKGROUND OF THE INVENTION

The present invention relates generally to a batting training apparatus and, more particularly, to a foot position training apparatus which restricts vertical and lateral movement of the back foot of a batter while batting a ball.

Children begin learning how to bat a ball almost as soon as they are able to hold a bat. In fact, children begin learning to play the game of baseball as early as kindergarten, usually by hitting a ball off a tee (Tee Ball). Teaching proper hitting technique, including batting stance, is important at a young age as bad habits may be difficult to correct. A significant problem with young batters is their tendency to move their back or plant foot while swinging a bat. Sometimes, young batters completely lift their back foot in an effort to make contact with the ball.

Various devices have been proposed in the prior art for teaching a proper batting stance. Existing devices provide instruction on where to stand or how to shift the front foot while swinging. While assumably effective for their intended purposes, existing devices do not address the problem of a young batter moving or raising his back foot while swinging the bat.

Therefore, it is desirable to have a foot position training apparatus that restricts vertical movement of a batter's back foot while batting a ball. Further, it is desirable to have a foot position training apparatus that restricts outward lateral movement of a batter's back foot while batting.

SUMMARY OF THE INVENTION

A foot position training apparatus according to the present invention includes a foot support member formed in the shape of a shoe with inner and outer edges extending between opposed front and rear edges. A toe portion includes a first edge integrally connected to the front edge of the foot support member and extends upwardly and rearwardly in a cap-like configuration defining a space suitable for receiving the toes of a batter's foot therein. The toe portion restricts the vertical movement of the batter's foot although the batter is able to intentionally remove his foot if necessary, e.g. to prevent falling down. An upstanding wall is integrally connected to a free edge of the toe portion and extends along the outer edge of the foot support member between the toe portion and the rear edge of the support member. Although the wall is not very tall and may even be characterized as a ridge, it extends sufficiently in the vertical direction so as to restrict the outward lateral movement of a batter's foot while batting a ball. In addition, the upper surface of the foot support member is sloped upwardly between the inner and outer edges thereof to further inhibit outward lateral movement of a batter's foot.

A plurality of cleats are removably coupled to a lower side of the foot support member. More particularly, the lower side of the support member defines a plurality of spaced apart threaded receptacles and each cleat includes a threaded end. Therefore, cleats may be threadably inserted into selected receptacles, if desired, so as to secure the support member to the ground.

Therefore, a general object of this invention is to provide an apparatus for training proper foot positioning related to batting a ball.

Another object of this invention is to provide an apparatus, as aforesaid, which restricts movement of a batter's back foot while batting.

Still another object of this invention is to provide an apparatus, as aforesaid, which restricts vertical movement of a batter's back foot while batting.

Yet another object of this invention is to provide an apparatus, as aforesaid, which restricts outward lateral movement of a batter's back foot while batting.

A further object of this invention is to provide an apparatus, as aforesaid, which easily receives a batter's foot prior to batting.

A still further object of this invention is to provide an apparatus, as aforesaid, which may be secured to a ground surface.

A particular object of this invention is to provide an apparatus, as aforesaid, that is compact and easy to transport.

Another particular object of this invention is to provide an apparatus, as aforesaid, which is constructed of durable materials.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

A foot position training apparatus according to the present invention will now be described with reference to FIGS. 1–6 of the accompanying drawings.

Figure 5:
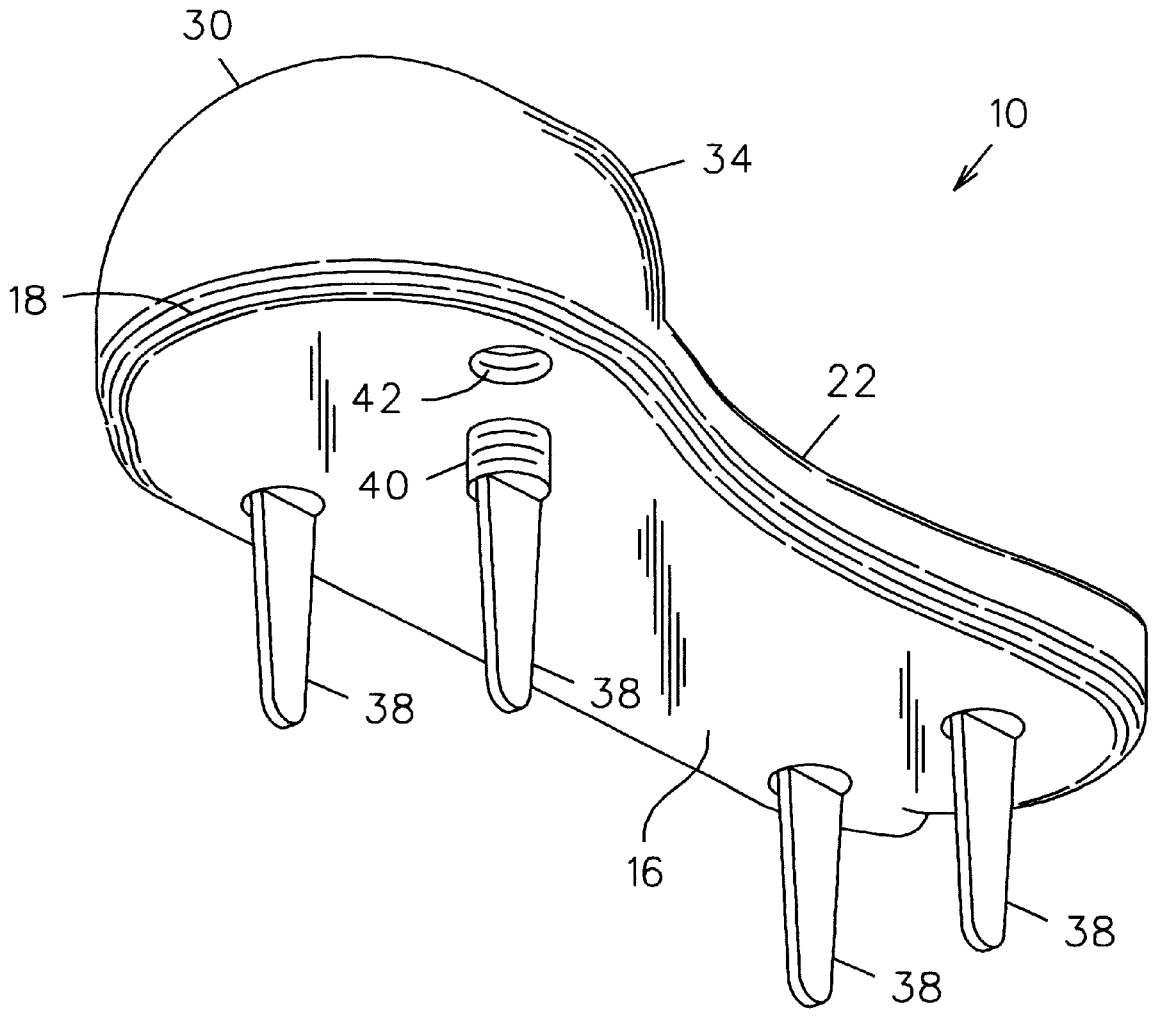
FIG. 5 is a perspective view of a bottom side of the apparatus as in FIG. 1.

According to one embodiment of the invention, a foot position training apparatus 10 includes a foot support member 12 having an upper surface 14 (FIG. 1) and a lower 16 surface (FIG. 5). The support member 12 has front 18 and rear 20 edges with inner 22 and outer 24 edges extending therebetween in the shape of the sole of a shoe. As with a shoe, the inner edge 22 bends inwardly between the positions of the ball and heel of a foot (FIG. 5). Preferably, the apparatus 10 is constructed of a molded plastic material although metal or other materials would also be suitable. The upper surface 14 of the support member, therefore, is particularly configured to support the foot of a batter thereon. It should be appreciated that while the description and drawings provided herein assume a right-handed batter, those skilled in the art would be able to construct a substantially similar apparatus particularly suited for left-handed batters.

Figure 1:
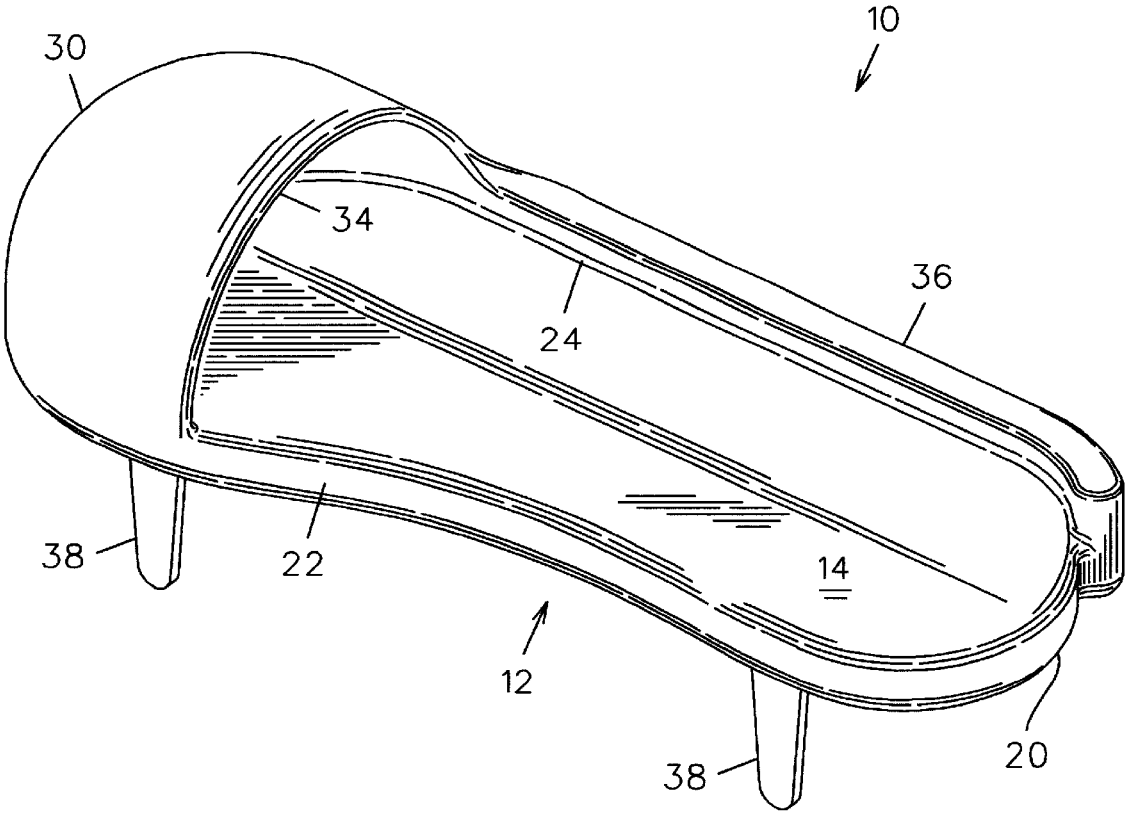
FIG. 1 is a perspective view of a foot position training apparatus according to one embodiment of the present invention.
Figure 2:
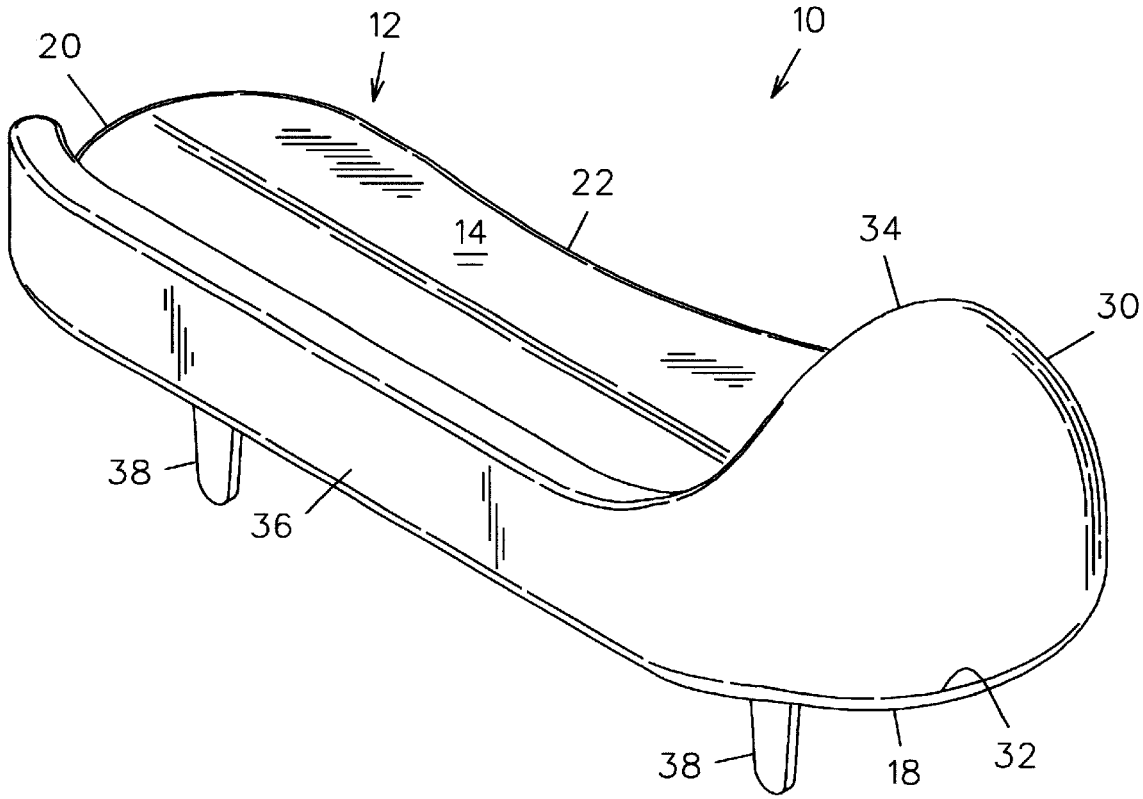
FIG. 2 is another perspective view of the apparatus as in FIG. 1.
Figure 3:
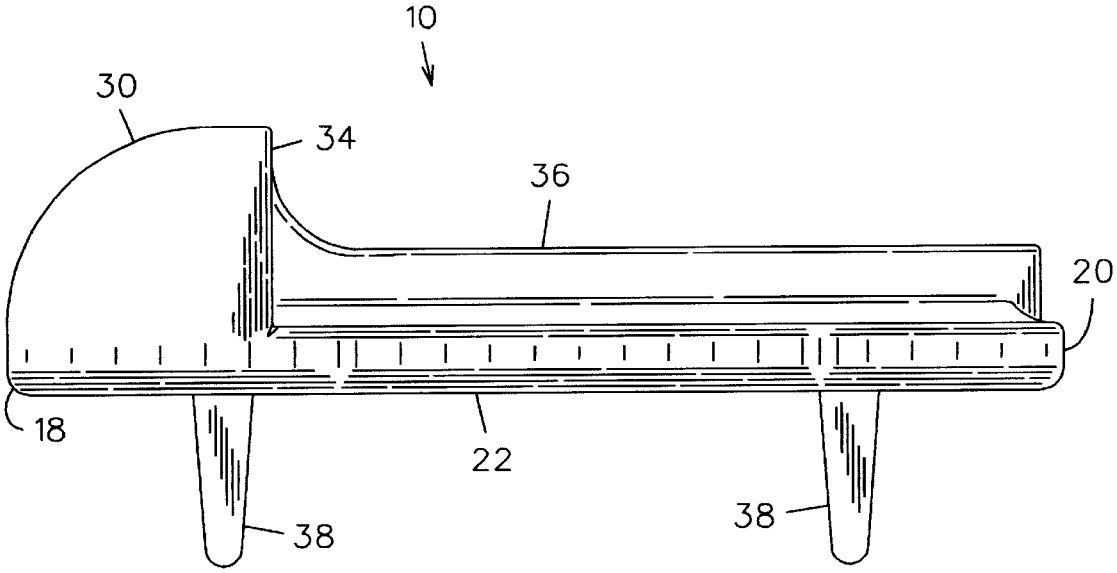
FIG. 3 is a left side view of the apparatus as in claim 3.
Figure 4:
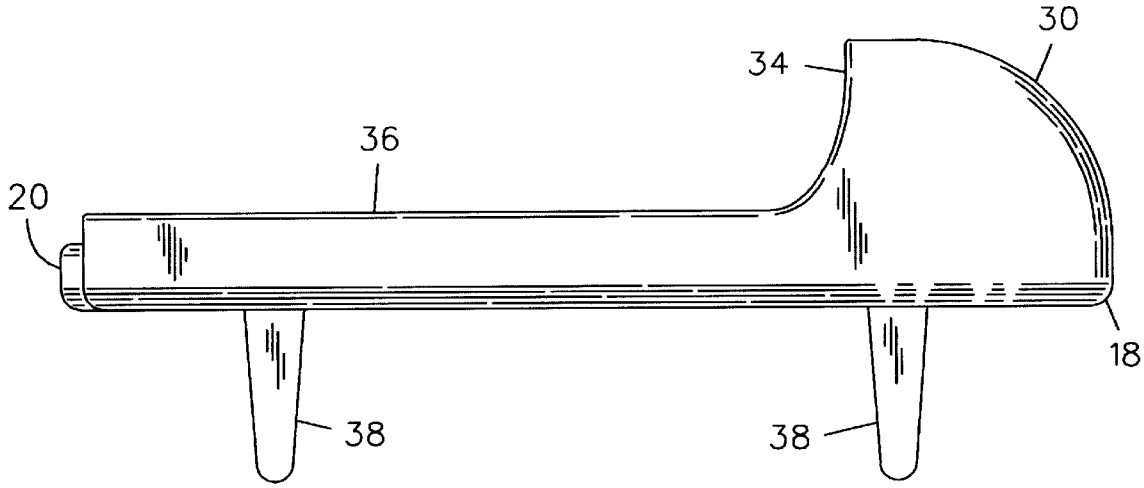
FIG. 4 is a right side view of the apparatus as in FIG. 1.

A toe portion 30 includes a first edge 32 integrally connected to the front edge 18 of the support member 12, the toe portion extending upwardly and rearwardly to a free edge 34 (FIG. 2). Also referred to as a toe box or toe cap, the toe portion 30 defines an open space that is sized for receiving the toes of a batter's foot therein and, more particularly, for receiving the toe portion of a batter's shoe (FIG. 1). The vertical movement of a batter's foot is restricted when received in the toe portion 30.

As shown in FIGS. 1 and 2, a vertically upstanding wall 36 is integrally connected to the free edge 34 of the toe portion 30 and extends along the outer edge 24 of the support member 12 between the toe portion 30 and the rear edge 20 of the support member 12. The wall 36 serves as a ridge that restricts outward lateral movement of a right-handed batter's foot. Further, the upper surface 14 of the support member 12 is sloped upwardly between the inner 22 and outer 24 edges so as to further inhibit outward lateral movement of a batter's foot. More particularly, this increased thickness or slope may be positioned adjacent the wall 36 so as to be felt only by the outside portion of a batter's foot (FIG. 1).

The apparatus 10 further includes a plurality of cleats 38 removably coupled to the lower surface 16 of the support member 12 (FIG. 5). It is understood, however, that the support member 12 could be adequately secured to the ground with only a single properly positioned cleat. The lower surface 16 defines a plurality of spaced apart threaded receptacles 42. Each cleat 38 includes a threaded end 40 configured to threadably mate with a receptacle 42. Each cleat 38 is of sufficient length to preclude slippage of the support member 12 when a batter shifts his weight while standing thereon. Therefore, the cleats 38 may be pressed into the ground when a batter places his foot upon the upper surface 14 of the support member 12 so as to restrict movement of the apparatus 10 during use.

In use, the foot position training apparatus 10 is positioned on the ground adjacent home plate of a baseball diamond at the position for a batter's back foot (plant foot). When cleats 38 are threadably coupled to the lower surface 16 of the support member 12, the apparatus 10 may be secured to the ground by stepping on the support member 12. A batter may then assume a proper batting stance by placing his back foot (the right foot for a right-handed batter) on the support member 12 such that the batter's toes are received by the toe portion 30. Vertical and outward lateral movements of the batter's back foot are thereafter restricted by the toe portion 30 and upstanding wall 36—though not totally prevented—when the batter swings a bat.

Figure 6:
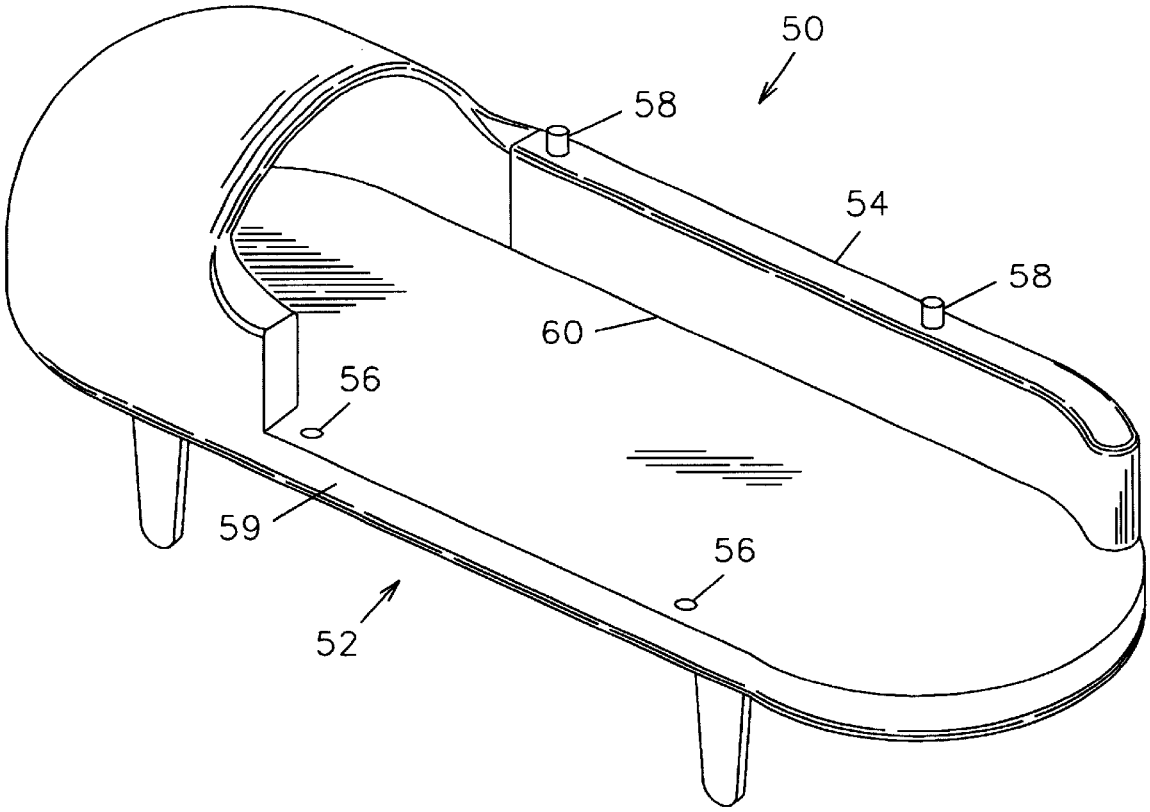
FIG. 6 is a perspective view of another embodiment of a foot position training apparatus according to the present invention.

Another embodiment of the apparatus 50 is shown in FIG. 6 and is constructed in a manner substantially similar to the apparatus 10 described above except as specifically noted below. In this embodiment, the inner 59 and outer 60 edges of the support member 52 present a symmetrical configuration and the wall 54 is removably coupled to the upper surface. More particularly, the upper surface defines a pair of cylindrical holes 56 adjacent each edge 59, 60 and the wall 54 includes a pair of cylindrical flanges 58 such as pegs on upper and lower edges thereof that are complementary to the holes 56 for insertion therein. Accordingly, the wall 54 may be removably coupled along either the inner or outer edge of the support member and therefore may be used to restrict outward foot movement of either left or right-handed batters.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A foot position training apparatus for teaching proper foot position for batting a baseball, comprising:

a foot support member having a configuration indicative of a shoe sole and having an upper surface adapted to receive a foot of a batter thereon, said foot support member including opposed inner and outer edges and a rear edge opposite said front edge, said upper surface being sloped upwardly between said inner and outer edges so as to inhibit outward lateral movement of said batter's foot when batting a baseball;

a toe portion having a first edge attached to a front edge of said foot support member and a free edge upwardly and rearwardly displaced from said first edge, said toe portion having a cap-like configuration defining a space adapted to receive the toes of a batter's foot, whereby to restrict vertical movement of said batter's foot when batting a baseball;

an upstanding wall attached to said outer edge and extending between said toe portion and said rear edge so as to restrict outward lateral movement of said batter's foot;

wherein said foot support member includes a lower surface defining a plurality of spaced apart threaded receptacles; and a plurality of cleats, each cleat having a threaded member configured to threadably mate with a respective receptacle, whereby to selectively secure said foot support member to a ground surface.

2. A foot position training apparatus for teaching proper foot position for batting a baseball, comprising:

a foot support member having a configuration indicative of a shoe sole and having an upper surface adapted to receive a foot of a batter thereon, said foot support member including opposed inner and outer edges and a rear edge opposite said front edge, said upper surface being sloped upwardly between said inner and outer edges so as to inhibit outward lateral movement of said batter's foot when batting a baseball;

a toe portion having a first edge attached to a front edge of said foot support member and a free edge upwardly and rearwardly displaced from said first edge, said toe portion having a cap-like configuration defining a space adapted to receive the toes of a batter's foot, whereby to restrict vertical movement of said batter's foot when batting a baseball;

an upstanding wall attached to said outer edge and extending between said toe portion and said rear edge so as to restrict outward lateral movement of said batter's foot;

wherein said upper surface of said foot support member defines at least one hole adjacent said outer edge and at least one hold adjacent said inner edge;

at least one flange extending from a bottom side of said wall adapted to selectively mate with said at least one hole adjacent said outer edge;

at least one flange extending from a top side of said wall adapted to selectively mate with said at least one hole adjacent said inner edge, whereby said wall is interchangeably coupled to said upper surface of said foot support member adjacent said outer or inner edge;

wherein said foot support member includes a lower surface defining a plurality of spaced apart threaded receptacles; and a plurality of cleats, each cleat having a threaded member configured to threadably mate with a respective receptacle, whereby to selectively secure said foot support member to a ground surface.

* * * * *